US005790144A

United States Patent [19]

Eade et al.

[11] Patent Number: 5,790,144

[45] Date of Patent: Aug. 4, 1998

[54] METHOD OF CONTROLLING AN OPERATING TEMPERATURE OF A PRINTHEAD IN AN INK JET CARTRIDGE ASSEMBLY

[75] Inventors: Thomas Jon Eade; Bruce David Gibson, both of Lexington; Randall David Mayo, Georgetown, all of Ky.

[73] Assignee: Lexmark International, Inc., Lexington, Ky.

[21] Appl. No.: 720,166

[22] Filed: Sep. 25, 1996

[51] Int. Cl.[6] ..... B41J 29/377

[52] U.S. Cl. ..... 347/18; 347/17; 347/19

[58] Field of Search ..... 347/14, 17, 18, 347/19, 5, 9

[56] References Cited

U.S. PATENT DOCUMENTS

| | | | |
|---|---|---|---|
| 4,651,166 | 3/1987 | Katsuragi | 346/76 PH |
| 4,873,536 | 10/1989 | Minowa et al. | 346/1.1 |
| 5,017,948 | 5/1991 | Koizumi et al. | 346/140 R |
| 5,059,044 | 10/1991 | Takaishi | 400/120 |
| 5,107,276 | 4/1992 | Kneezel et al. | 346/140 |
| 5,367,325 | 11/1994 | Yano et al. | 347/17 |
| 5,483,273 | 1/1996 | Fujimoto et al. | 347/195 |
| 5,576,745 | 11/1996 | Matsubara | 347/14 |
| 5,623,292 | 4/1997 | Shrivastava et al. | 347/18 |

*Primary Examiner*—John S. Hilten
*Attorney, Agent, or Firm*—Ronald K. Aust

[57] ABSTRACT

The invention is directed to a method of controlling an operating temperature of a printhead in an ink jet cartridge assembly, with the printhead having a plurality of ink emitting orifices and a plurality of corresponding heater elements. A cooling rate of the printhead which occurs during inoperation of the heater elements is established. A heating rate of the printhead which occurs as a result of firing at least one of the heater elements is determined. A period of time is set. A variable representing a control temperature of the printhead is calculated, dependent upon each of the cooling rate and the heating rate during the period of time. The operating temperature of the printhead is controlled, dependent upon the value of the variable representing the control temperature.

8 Claims, 3 Drawing Sheets

METHOD OF CONTROLLING AN OPERATING TEMPERATURE OF A PRINTHEAD IN AN INK JET CARTRIDGE ASSEMBLY

BACKGROUND OF THE INVENTION

1. Field of the Invention

The present invention relates to image forming apparatus, and, more particularly, to ink jet printers.

2. Description of the Related Art

An ink jet printer typically includes an ink jet cartridge assembly having a printhead with a plurality of ink emitting orifices and a plurality of corresponding heater elements. The heater elements are selectively fired during operation to create a rapidly expanding bubble which jets a droplet of ink onto a print medium.

During operation, the total heat input to the printhead is a function of the total number of heater elements which are fired during a particular period of time. As the temperature of the printhead increases due to the heat input, the viscosity and surface tension of the ink decrease. As a result, the drop mass of the ink droplets which are deposited onto the print medium is increases and the print becomes darker. This may result in an undesirable print artifact being formed on the print medium. Examples of printing conditions which may result in temperature variations of the printhead affecting the drop mass of the ink (and thus the print quality) include heavy graphics printing, time delays during print scans, printhead maintenance cycles, and slow transfer of print data from the host computer.

One known method of controlling the temperature of a printhead is to utilize separate temperature sensors on the printhead. The temperature sensors are connected to appropriate electrical circuitry. Heat may be applied to the printhead or the printhead may be allowed to cool, depending upon the sensed temperature. A problem with utilizing such sensors is that complexity and manufacturing costs are increased because of the associated electrical and mechanical hardware. Moreover, the mere presence of such additional hardware by itself increases the possibility for failures to occur.

What is needed in the art is a method of controlling the operating temperature of a printhead which does not rely upon relatively expensive, complicated and sometimes unreliable hardware in the form of additional sensors, electrical circuits, etc.

SUMMARY OF THE INVENTION

The present invention provides a method of controlling an operating temperature of a printhead by using a known cooling rate of the printhead over a period of time and the heat input to the printhead over the same period of time.

The invention comprises, in one form thereof, a method of controlling an operating temperature of a printhead in an ink jet cartridge assembly, with the printhead having a plurality of ink emitting orifices and a plurality of corresponding heater elements. A cooling rate of the printhead which occurs during inoperation of the heater elements is established. A heating rate of the printhead which occurs as a result of firing at least one of the heater elements is also determined. A period of time is set. A variable representing a control temperature of the printhead is calculated, dependent upon each of the cooling rate and the heating rate during the period of time. The operating temperature of the printhead is controlled, dependent upon the value of the variable representing the control temperature.

An advantage of the present invention is that the operating temperature of the printhead may be controlled without using temperature sensors on the printhead, thereby reducing physical complexity and manufacturing costs.

Another advantage is that a control temperature utilized to control the operating temperature of the printhead may be adjusted during operation.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
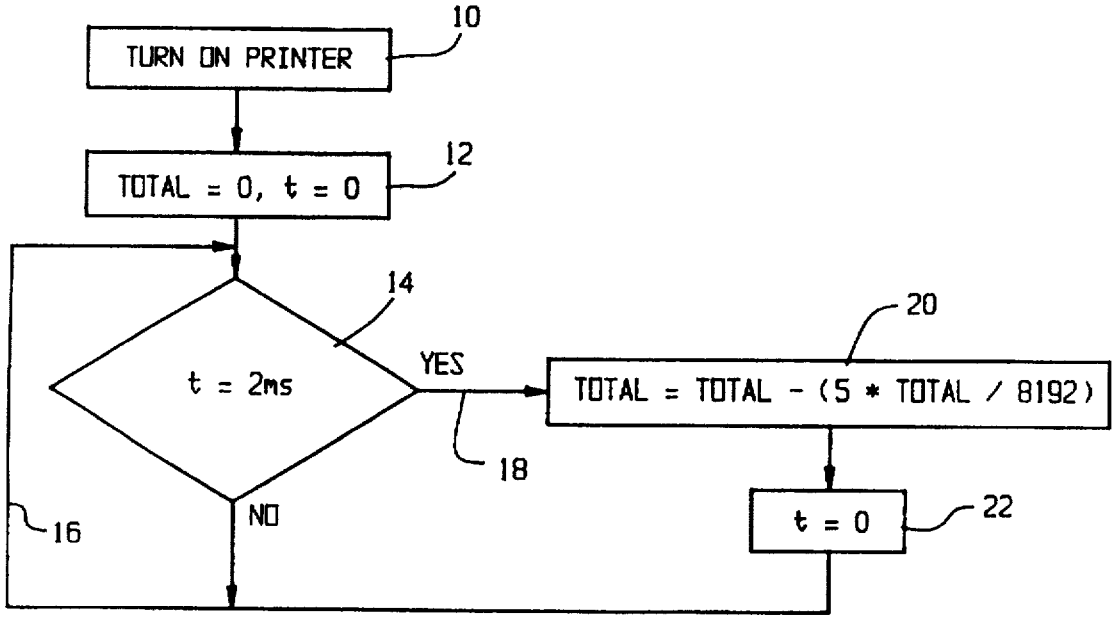
FIG. 1 is a flowchart of a method of the present invention for calculating a variable representing an operating temperature of the printhead at a particular point in time.

In general, the heat transfer of the printhead as the ink jet cartridge assembly is used during a scan of the ink jet cartridge assembly across a print medium relates to the heat input to the printhead and the heat output from the printhead. More particularly, the temperature increase of the printhead is dependent upon the heat input to the printhead during a particular period of time. During a scan of the ink jet cartridge assembly, the heater elements are selectively fired to jet ink drops onto the print medium and thereby create the desired image. Since each heater element inputs a predetermined amount of heat into the printhead upon firing thereof, the total amount of heat input to the printhead is a function of the total number of heater elements which are fired during a particular period of time. Conversely, since the heater elements are only intermittently fired during a scan of the ink jet cartridge assembly, cooling of the printhead occurs during periods of inoperation of the heater elements. Cooling of the entire printhead results if all of the heater elements are inactive. Moreover, cooling of the printhead may be of a local nature if a particular heater element is inactive. Thus, the operating temperature of the printhead is a function of both the total heat input to the printhead over a period of time and the cooling rate of the printhead over the same period of time.

With the present invention, a cooling rate which occurs during inoperation of the heater elements is established for a printhead with a known physical construction. Likewise, a heating rate of the printhead which occurs as a result of firing at least one of the heater elements is determined. The heating rate or temperature increase of the printhead associated with firing one of the heater elements can also be used for extrapolation of the heating rate of the printhead which occurs when multiple heater elements are fired over a period of time. The heating rate and cooling rate are used to estimate an operating temperature of the printhead.

In the flow charts shown in FIGS. 1, 2A and 2B, the variables to be described hereinafter are calculated using mathematical equations including a number of coefficients and constants. These coefficients and constants have been determined based upon empirical testing. For the particular methods shown in FIGS. 1, 2A and 2B, the printhead is a monochrome printhead including a nozzle plate with 104 orifices having a diameter of approximately 45–50 microns and a length of approximately 50–55 microns. The heater elements associated with each orifice have a resistance of approximately 30 ohms, and were fired for a period of approximately 2.7 micro seconds at about 13 volts. Two separate bulk heaters located at opposing ends of the printhead each have a resistance of approximately 50 ohms and are driven simultaneously at about 13 volts. The monochrome ink used in the printhead has a surface tension of about 49 dynes/cm at 22° C. and a viscosity of about 3.15 centipoise at 22° C. The mathematical equations for a comparably constructed color printhead would be similar, but with different coefficients and constants.

Figure 2A:
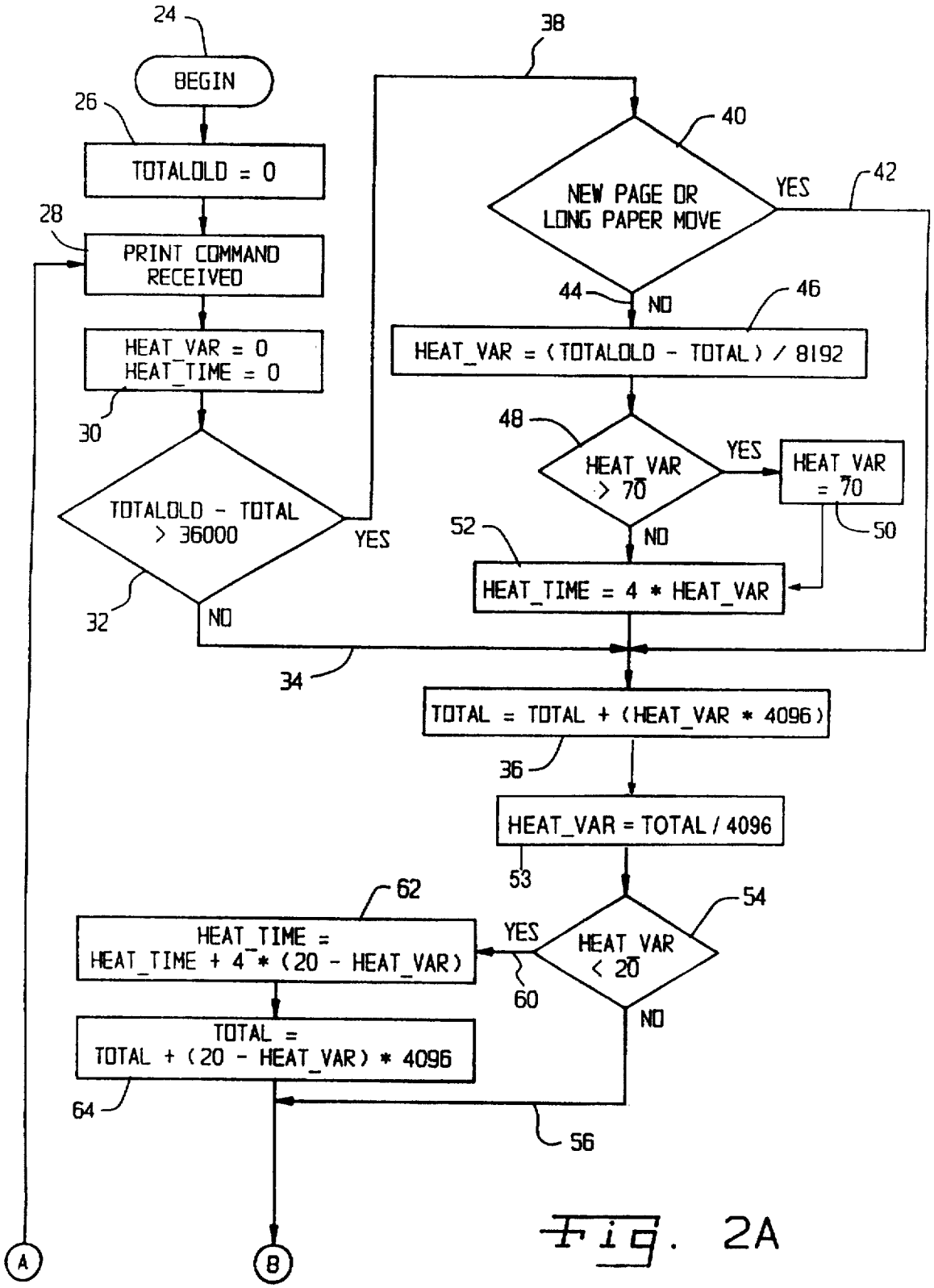
FIGS. 2A and 2B illustrate a flowchart of a method of the present invention for controlling an operating temperature of the printhead.
Figure 2B:
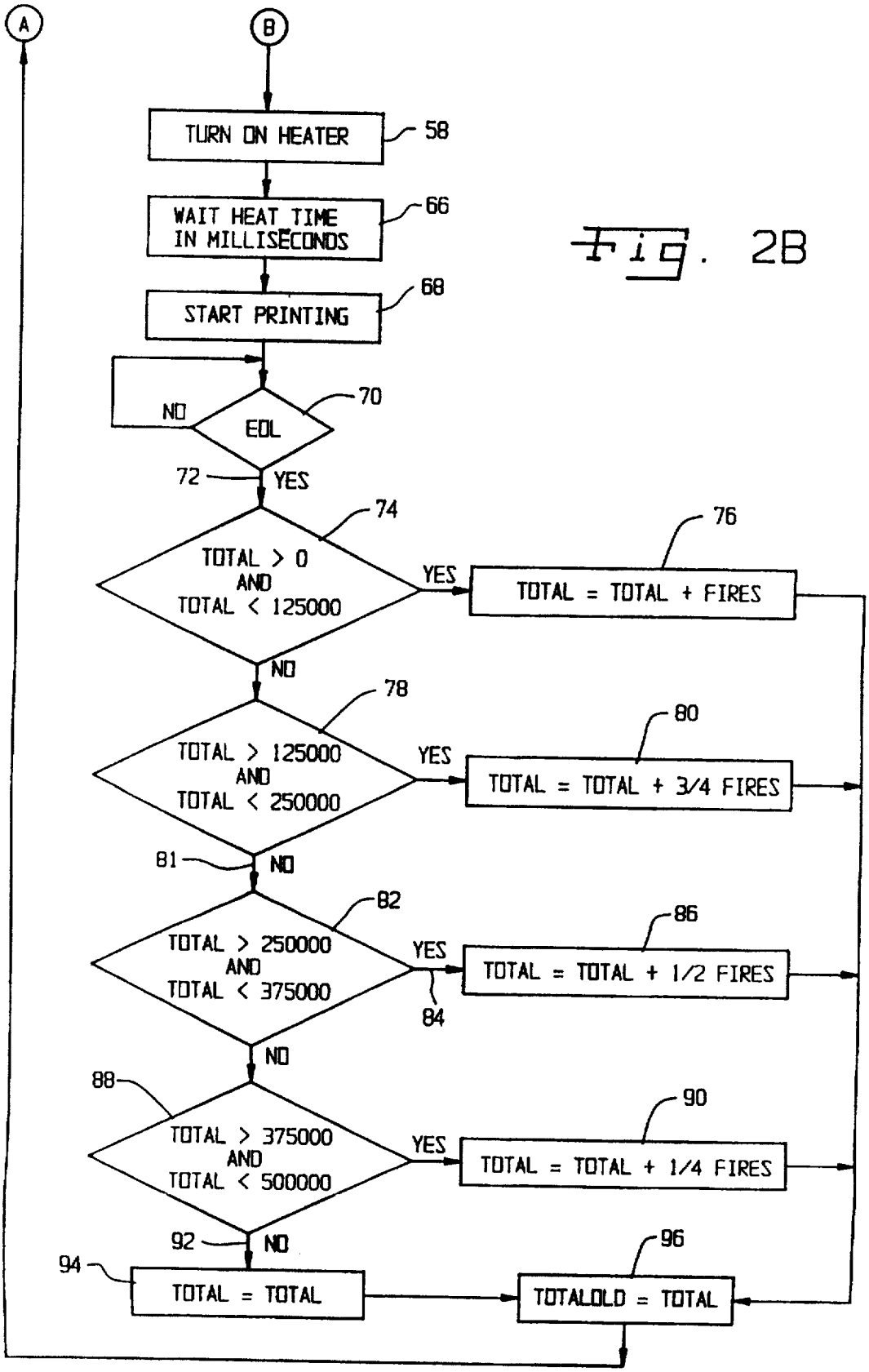

Referring now more specifically to FIG. 1, there is shown a flowchart representing an embodiment of a method of the present invention for calculating a variable TOTAL which corresponds to the operating temperature or control temperature of the printhead at a particular point in time. The variable TOTAL is recalculated during operation of the printer at predetermined intervals of time. In the embodiment shown, and as will be described hereinafter, the variable TOTAL is recalculated every two milliseconds. More particularly, when the printer is turned ON (block 10), the variable TOTAL representing the operating temperature of the printhead and the variable "t" representing time are initialized to zero (block 12). Thereafter, a wait state occurs during which the variable t is incremented (decisional block 14 and line 16). When the variable t has been incremented to two milliseconds (such as by using the clock speed of a processor in the printer), the variable TOTAL is recalculated (line 18 and block 20). It will be appreciated that after the printer is turned ON and before printing starts, the variable TOTAL is still equal to zero and the recalculated value of TOTAL in block 20 is equal to zero. However, after printing begins, and as will be described hereinafter with reference to FIG. 2, the variable TOTAL is set to a value other than zero, and the recalculated value TOTAL in block 20 is no longer equal to zero. After the value of TOTAL is recalculated in block 20, the variable t is reset to zero and a wait state again occurs at decisional block 14 and line 16. The process shown in FIG. 1 for recalculating the variable TOTAL every two milliseconds thus takes place during the entire period of time during which the printer is turned ON.

Referring now to FIG. 2, there is shown an embodiment of a flow chart representing a method of controlling an operating temperature of the printhead. After the printer is turned ON (block 24), a variable TOTALOLD is initialized to zero (block 26). After a print command is received from, e.g., a host computer (block 28), the variables HEAT_VAR and HEAT_TIME are each initialized to zero (block 30). Thereafter, the variable TOTAL is subtracted from the variable TOTALOLD (decisional block 32). At this point, the variable TOTALOLD corresponds to the initialized value of zero when the printer is turned ON, or a previously calculated value of the variable TOTAL during a previous pass through the flow chart shown in FIG. 2. If the difference between the variable TOTALOLD and TOTAL is less than or equal to 36,000 (line 34) indicating a very short period of cooling has occurred, then control passes directly to block 36 where the value of the variable TOTAL is calculated. On the other hand, if the difference between the variable TOTALOLD and TOTAL is greater than 36,000 (line 38), then a determination is made as to whether a new page or long paper move has occurred (decisional block 40). If the result from decisional block 40 is YES (line 42), then any change in ink drop mass will not likely be apparent as an objectionable print artifact and control passes directly to block 36, where the variable TOTAL is recalculated.

On the other hand, if the result from decisional block 40 is NO (line 44), then an objectionable print artifact may be visible and a period of time is calculated during which the printhead is heated. To that end, a variable HEAT_VAR is calculated as the difference between the variables TOTALOLD and TOTAL, divided by a constant 8192 (block 46). If the value of the variable HEAT_VAR is greater than 70 (decisional block 48), then the value of HEAT_VAR is set to 70 (block 50). In block 52, a variable HEAT_TIME (representing a period of time during which a heater, such as for example the bulk heater, in the printhead is turned ON) is calculated as being four times the value of the variable HEAT_VAR.

At block 36, the variable TOTAL is calculated as being the existing value of TOTAL plus the product of the variable HEAT_VAR times the constant 4096. Thereafter, at block 53, the variable HEAT_VAR is calculated as being the then existing value of TOTAL divided by the constant 4096. A determination is then made as to whether the variable HEAT_VAR is less than the value 20 (decisional block 54). If the result is NO (line 56), then control passes directly to block 58 and the heater is turned ON. On the other hand, if the result from decisional block 54 is YES (line 60), then the variable HEAT_TIME is calculated as being the presently existing value of HEAT_TIME plus the product 4 times (20—HEAT_VAR) (block 62). After the variable HEAT_TIME is calculated in block 62, the variable TOTAL is calculated in block 64 as being the presently existing value of TOTAL plus the product of 4096 times the quantity (20—HEAT_VAR).

After the heater is turned ON in block 58, the heater is maintained in the ON state for a period of time in milliseconds corresponding to the calculated value of the variable HEAT_TIME (block 66). The period of time during which the heater is maintained in an ON state is such that the ink has desired physical properties such as viscosity, surface tension, etc.

At block 68, an actual printing process occurs such that an ink jet cartridge moves across a scan line on the print medium and jets ink at selected locations thereon. After the ink jet cartridge scans across a particular scan line and an end of line (EOL) condition exists (decisional block 70 and line 72), the value of the variable TOTAL is adjusted dependent upon the number of times that the heater elements were fired as the ink jet cartridge assembly traversed across the scan line. In the particular embodiment shown, the number of fires of the heater elements which is added to the variable TOTAL is adjusted using a weighting factor dependent upon the presently existing value of the variable TOTAL. The smaller weighting factor associated with a larger value of the variable TOTAL is related to the cooling effect that a larger number of fires of the heater elements has on the printhead (i.e., an increased cooling effect associated with a larger ink flow rate).

Referring to decisional block 74, if the value of the variable TOTAL is between 0 and 125,000, then the number of fires of the heater elements is added to the calculated value of the variable TOTAL (block 76). Likewise, if the value of the variable TOTAL is between 125,000 and 250,000 (block 78), then a weighting factor of ¾ is multiplied times the number of fires of is the heater elements. This weighted number of fires of the heater elements is then added to the calculated value of TOTAL to produce a newly calculated value of TOTAL corresponding to a control temperature of the printhead (block 80). If the result from decisional block 78 is determined to be NO (line 81) and the value of the variable TOTAL is between 250,000 and 375,000 (decisional block 82 and line 84), then a weighting factor of ½ is multiplied by the number of fires of the heater elements. This weighted number of fires of the heater elements is then added to the calculated value of TOTAL to produce a newly calculated value of TOTAL (block 86). Similarly, if the value of the variable TOTAL is between 375,000 and 500,000 (decisional block 88), a weighting factor of ¼ is multiplied by the number of fires of the heater elements (block 90). Finally, if the value of the variable TOTAL is determined to be greater than 500,000 (line 92), then a weighting factor of zero is multiplied by the number of fires of the heater elements (block 94; i.e., the value of the variable TOTAL remains unchanged). At block 96, the variable TOTALOLD is set to equal the value of the variable TOTAL, and control passes back to block 28.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of controlling an operating temperature of a printhead in an ink jet cartridge assembly, the printhead including a plurality of ink emitting orifices and a plurality of corresponding heater elements, said method comprising the steps of:

establishing a cooling rate of the printhead which occurs during inoperation of at least one of the heater elements;

determining a heating rate of the printhead which occurs as a result of firing at least one of the heater elements;

setting a period of time;

calculating a variable representing a control temperature of the printhead, dependent upon each of said cooling rate of the printhead during said period of time and said heating rate of the printhead during said period of time, said control temperature corresponding to a desired operating temperature of the printhead; and controlling the operating temperature of the printhead, dependent upon said calculating step.

2. The method of claim 1, wherein said controlling step comprises applying heat to the printhead.

3. The method of claim 1, wherein said controlling step comprises allowing the printhead to cool.

4. The method of claim 1, wherein said calculating step comprises calculating a variable representing a control temperature of the printhead, dependent upon a total number of the heater elements which are fired during said period of time.

5. The method of claim 4, wherein said control temperature is calculated using the product of a weighting factor and the total number of the heater elements which are fired during said period of time.

6. The method of claim 1, comprising the further steps of:

assigning said variable representing said control temperature as an old control temperature; and repeating said calculating step to calculate a variable representing a new control temperature of the printhead.

7. The method of claim 6, comprising the further step of comparing said newly calculated control temperature with said old control temperature, said controlling step being dependent upon said comparing step.

8. The method of claim 1, wherein said determining step comprises determining a heating rate of the printhead which occurs as a result of firing one of the heater elements.

* * * * *